United States Patent [19]

Oelsch et al.

[11] Patent Number: 4,635,028

[45] Date of Patent: Jan. 6, 1987

[54] SLIDER FOR RESISTOR AND SLIP CONDUCTORS

[75] Inventors: Kurt Oelsch; Klaus Schulz, both of Berlin, Fed. Rep. of Germany

[73] Assignee: Oelsch Kommanditgesellschaft, Berlin, Fed. Rep. of Germany

[21] Appl. No.: 720,867

[22] Filed: Apr. 8, 1985

[30] Foreign Application Priority Data

Apr. 12, 1984 [DE] Fed. Rep. of Germany ..... 3413741

[51] Int. Cl.[4] ..... H01C 10/32

[52] U.S. Cl. ..... 338/171; 338/167; 338/170; 338/176; 338/202

[58] Field of Search ..... 338/118, 128, 133, 160, 338/162, 167, 169–171, 174, 176, 183, 190, 194

[56] References Cited

U.S. PATENT DOCUMENTS

| | | | |
|---|---|---|---|
| 3,569,897 | 3/1971 | Laube et al. | 338/202 X |
| 3,617,976 | 11/1971 | Campbell | 338/183 X |
| 3,876,967 | 4/1975 | Hehl et al. | 338/202 X |
| 3,982,221 | 9/1976 | Smith | 338/202 |
| 4,274,074 | 6/1981 | Sakamoto | 338/171 X |
| 4,511,879 | 4/1985 | Fujii | 338/171 X |

*Primary Examiner*—Arthur T. Grimley
*Assistant Examiner*—Jane K. Lau
*Attorney, Agent, or Firm*—Lee, Smith & Zickert

[57] ABSTRACT

A slider for resistor or slip conductors. The slider includes a generally U-shaped slider support having a center portion and two legs, leaf springs attached to each one of the legs and extending into the interior of the U-shaped slider support, and contact means guided by the leaf springs and kept in engagement with the resistor or slip conductor. In accordance with the invention, one of the leaf springs supports the contact means, and the other leaf spring resiliently engages the first leaf spring on the side remote from the resistor or slip conductor.

6 Claims, 2 Drawing Figures

SLIDER FOR RESISTOR AND SLIP CONDUCTORS

The invention relates to a slider for resistor or slip conductors, comprising (a) a generally U-shaped slider support having a center portion and two legs, (b) leaf springs attached to one of the legs each and extending into the interior of the U-shaped slider support, and (c) contact means guided by the leaf springs and kept in engagement with the resistor or the slip conductor.

Such a slider is known from the UK patent publication No. 474 406. This printed publication shows a slider having a slider support, which presents two parallel legs. A plurality of leaf springs spaced side-by-side, extends alternatingly from the one and the other leg into the interior of the slider support. The leaf springs are bent off at an angle downwards and, adjacent to the bending off, they form a section extending parallel to the slider support, which section is supported as contact means on the resistor or slip conductor, and which ends in a bent off edge.

With such a slider, asymmetries occur:

With this construction each leaf spring is clamped on one side only and is without any operative connection with other leaf springs. Quick movements of the slider may therefore cause "jumping" of the leaf spring.

From U.S. Pat. No. 3,982,221, a slider for resistor or slip conductors is known, which slider is bent out of a sheet metal cutting. A first bent part of sheet metal extends along an edge, from a center portion arranged approximately parallel to the resistor or slip conductor forming an acute angle with the resistor or the slip conductor. This part of sheet metal forms, at its free edge, a contact which engages the resistor or slip conductor. A second part of sheet metal extends at an acute angle inwards, from the opposite edge of the center portion. This second part of sheet metal engages the inner side of the first part of sheet metal remote from the resistor or slip conductor, when the slider is pressed against the resistor or slip conductor.

The second part of sheet metal is shorter than the first one and is stiffly flexible. Thereby the contact force is to be increased.

Also this arrangement is asymmetric. In order to increase the cntact force the spring constant is increased. An increase of the contact force is not desirable for many applications, particullarly with measuring potentiometers, as hereby the friction and thus the force required for adjustment is increased. A slider safely ensuring contact at low but constant contact force is desirable. An increased spring constant due to the stiffly flexible part of sheet metal makes the contact force more sensitive to small up and down movements of the slider. Also the resonance frequency of the slider is increased, thereby increasing the risk of "jumping" of the contacts.

German patent publication No. 3 247 410 (not prepublished) describes a slider having a generally U-shaped slider support, to which a pair of biased leaf springs is attached. The free ends of the leaf springs are interconnected by a bridge piece extending approximately in the same plane as the free end ranges of the leaf springs. The longitudinal axis of the bridge piece extends at an angle relative to the respective resistor and slip conductor. A wire helix surrounding the bridge piece contactingly engages, with its turns, the resistor or slip conductor. The inner diameter of the wire helix is larger than the width of the bridge piece, and the winding axis of the wire helix extends perpendicularly to the resistor or slip conductor. The slider support has a center portion and two legs extending substantially at a right angle therefrom and to the resistor and slip conductor. Both spring leafs are attached to one of the legs each, and extend into the interior of the U-shaped slider support. In their free end ranges, the leaf springs overlap in longitudinal direction at least by the width of said bridge piece. They are arranged at a distance from each other at an angle to their longitudinal directions, the distance being at least equal to the width of the resistor or slip conductor. The free leaf springs are bent up relative to the plane of the center portion of the slider support in the direction of the resistor or slip conductor, and they are bent because of their bias by a larger distance than the amplitude of any possible movement perpendicular to the resistor or slip conductor, respectively, when the slider is moved. The bridge piece and the leaf springs consists of an integral part of spring sheet metal. In a preferred embodiment, a second pair of additional leaf springs with a second bridge piece is attached at the part of spring sheet metal. These second leaf springs extend substantially parallel to the first pair of leaf springs causing the contact with the resistor conductor. A slip conductor extends parallel to the resistor conductor. The arrangement of the second pair of leaf springs, the second bridge piece and a second wire helix contactingly engaging the slip conductor relative to each other and to the slip conductor are idendical with the arrangement of the slider elements cooperating with the resistor conductor. This slider is asymmetric and has a correspondingly asymmetric mass distribution.

It has been found that such a slider is subjected to mechanical strain which reduces its useful life, in case of quick alternating motion, as f.ex. motion with the mains frequency.

Furthermore a potentiometer pick-off (German Pat. No. 2 508 530) is known, which ensures that the wire helix is guided freely from hysteresis and that the bridge piece and the wire helix are in well-defined contact, without particularly small tolerances being required. A flat bridge piece is formed at the free end of the leaf spring and extends into the interior of the wire helix, parallel to its longitudinal axis. The width of this bridge piece is smaller than the inner diameter of the wire helix and, in the center range of the bar, it is smaller than at its end. The bridge piece extends only loosly into the wire helix, the inner diameter of the wire helix being clearly larger than the width of the bridge piece. Thereby no small tolerances have to be taken into account for bridge piece and wire helix. Also the inherent elacticity of the wire helix is uncritical. Thereby the assembly is substantially simplified because the wire helix can be pushed easily with play onto the bar. The guidance free from hysteresis and the contact between wire helix and bridge piece are ensured by the contact force acting as a result of the bias of the leaf spring onto the bridge piece. This force serves also to press the potentiometer pick-off or the like against the resistor or slip conductor. By this contact force, the bridge piece is pressed into the turns of the wire helix engaging the conductor, and with its edges engages the helix on both sides. The wire helix assumes a well-defined position relative to the bridge piece, freely from hysteresis, that is independently of the direction of movement of the potentiometer pick-off or the like.

The contact between bridge piece and wire helix is determined by the contact force acting on the bridge piece and being transmitted onto the respective conductor through the bridge piece and wire helix. This contact force can easily be provided by a spring supple but correspondingly biased, such that slight movements of the bridge piece do not noticeably influence the contact force.

Due to the fact that the width of the bridge piece is smaller in its center area than at the ends, it can adapt to the contour of the resistor and slip conductor without an inadmissible hysteresis being caused.

The leaf spring is U-shaped and its center portion forms the bridge piece. In another embodiment, the bridge piece and the wire helix arranged thereon extend at an angle to a resistor and slip conductor. The disadvantage of these embodiments is the tendency of the slider to pump when the direction of rotation is reversed quickly whereby contact is not safely ensured any more.

It is the object of the invention to provide a slider simple in construction and appropriate for alternating motion without hysteresis and jumping, and in which strains due to mass asymmetry are prevented.

According to the invention, this object is achieved in that (d) one of the leaf springs supports the contact means and (e) the other leaf spring resiliently engages the first leaf spring, on the side remote from the resistor or slip conductor.

With very quick movements of the slider, for example at mains frequency, the masses of the leaf springs and the inertial forces acting thereon have to be taken into consideration. The following will be apparent from consideration of a leaf spring which engages a resistor or slip conductor and which forms an acute angle with this resistor or slip conductor: When the movement of the slider is reversed towards the angle point of this acute angle, the inertial force will act on the leaf spring such as to increasingly urge the leaf spring against the resistor or slip conductor. The inertial force actually seeks to maintain the original direction of movement of the leaf springs, when such a reversal of motion occurs. Thus the inertial force acts in the direction of the open side of the acute angle. Thereby it exerts a torque on the leaf spring about the clamping point thereof, said torque seeking to increase the angle between leaf spring and resistor or slip conductor and thus urges the leaf spring against the resistor or slip conductor. When the motion is reversed to the opposite direction, i.e. if the slider, at first, is moved in the direction of the angle point of the acute angle and then, after reversal of motion, is moved in the direction of the open side of the acute angle, the inertial force will act on the leaf spring in the direction of the angle point of the acute angle. Thus the inertial force will produce a torque about the clamping point such that the torque will seek to lift the leaf spring from the resistor or slip conductor. When a second leaf spring, which extends in opposite direction, engages the first leaf spring, the contacting and lifting forces caused by the inertial forces will act on the second leaf spring in opposition to the forces acting on the first leaf spring: When the first leaf spring is additionally urged into contact by the inertal force, the contacting force exerted thereon by the second leaf spring will be reduced by the inertial force acting on the second leaf spring. When the inertial force acting on the first leaf spring seeks to lift this leaf spring from the resistor or slip conductor, the contacting force exerted by the second leaf spring will be increased by the contacting force which results from the inertial force acting on this leaf spring. Therefore the contact force between slider and resistor or slip conductor remains substantially constant also if the slider is moved quickly back and forth. It is possible to use a rather small contact force between slider and resistor or slip conductor without the risk of jumping of the slider.

Modifiactions of the invention are subject matter of the sub-claims.

An embodiment of the invention will now be described in further detail with reference to the accompanying drawings.

Figure 1:
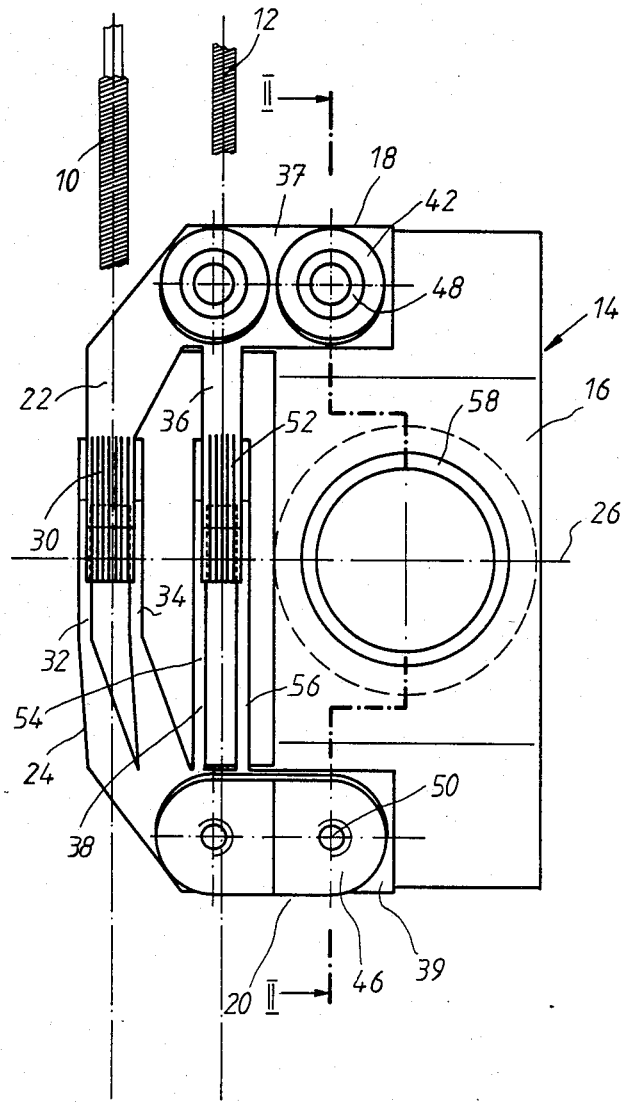
FIG. 1 shows a plan view of a potentiometer pick-off having a potentiometer winding and an additional slip conductor.

Numeral 10 designates a resistor conductor and numeral 12 designates a slip conductor parallel thereto. The slider comprises a generally U-shaped slider support 14. The slider support 14 has a center portion 16 and two legs 18 and 20 extending essantially perpendicularly thereto and to the resistor and slip conductor 10 and 12, respectively. Two leaf springs 22 and 24 are attached to one of the legs 18 and 20 each and extend into the interior of the U-shaped slider support 14. Contact means are guided by the leaf springs 22 and 24 and kept in engagement with the resistor conductor 10. One of the leaf springs 22 supports the contact means. The other leaf spring 24 rersiliently engages the first leaf spring 22 on the side remote from this resistor conductor 10. The legs 18 and 20 are bent off at an angle to the center portion 16 of the slider support 14, such that the leaf springs 22 and 24, respectively, attached to the legs 18,20 are bent off with respect to the plane of the center portion 16 in the direction of the resistor conductor 10 and with their longitudinal axis form an obtuse angle. The free ends of the leaf springs are bent, because of their bias, by a larger distance than the amplitude of any possible movement perpendicular to the resistor 10, when the slider is moved over the resistor. The leaf spring 22 supporting the contact means has such a length that the contact means are kept slightly asymmetrical to the center plane 26 of the slider support. The other leaf spring 24 is longer than the leaf spring 22. It extends over the latter and engages it on the other side of the center plane. The leaf spring 24 has a flat U-shaped bent end, which engages the leaf spring supporting the contact means. In the illustrated embodiment, the contact means are formed by a brush slider 30. Instead also a wire helix of the type described above could be provided as contact means. As can be seen from FIG. 1, the leaf spring 24 consists of two separate arms extending parallel to each other and interconnected by a bent end. By the thus formed aperture it is ensured that the leaf spring 24, although it is longer than the leaf spring 22, has substantially the same mass as the leaf spring 22.

Figure 2:
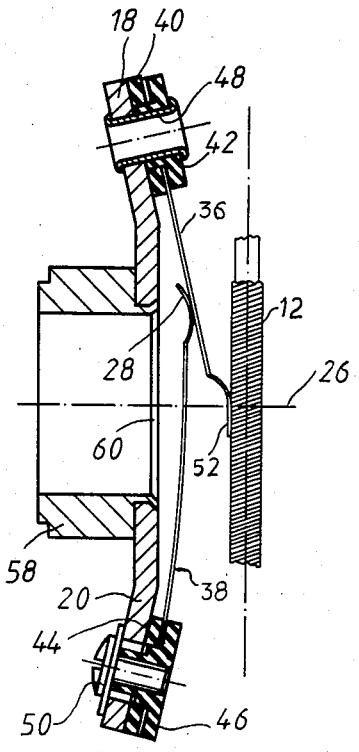
FIG. 2 shows a sectional view of potentiometer pick-off according to FIG. 1 taken along line II—II of FIG. 1.

As shown in FIG. 2, a second pair of leaf springs 36 and 38 is attached to the legs 18,20 of the slider support 14. Each of these leaf springs is formed, together with one leaf spring 22 and 24, respectively of the first pair causing the contact with the resistor conductor, by a continuous part of spring sheet metal 36 and 38, respectively. The parts of spring sheet metal 36 and 38 are located between insulating parts 40,42 and 44,46, respectively, which are connected by rivet 48 or screws 50, respectively, to the legs 18 and 20, respectively. As can be seen from FIG. 1, each part of spring sheet metal is attached by two rivets and two screws, respectively. The second pair of leaf springs 36,38 extends substantially parallel to the first pair of leaf springs 22,24. A leaf spring 36 of the second pair supports contact means, also in the form of a brush slider 52, contactingly engaging to the slip conductor 12. The other leaf spring 38 of the second pair engages the first leaf spring 36 at a U-shaped bent end 28, like the slider portions engages the resistor conductor 10. Also here the leaf spring 38 has an aperture, such that it is formed by two connected arms 54 and 56 and has substantially the same mass as the leaf spring 36. A circular aperture surrounded by a collar 58 is provided in the slider support 14. Therewith, the slider support 14 can be mounted on a potentiometer shaft.

The resistor and slip conductors only schematically indicated in the figures, extend, of course, concentrially about the axis of the potentiometer shaft.

The described slider is, unlike the above mentioned patent application No. P 32 47 410.5-34, symmetrically constructed with regard to the masses of the leaf springs. Also the leaf springs of each pair are arranged at the same distance from the axis of the potentiometer shaft and are not radially offset. It has been found that hereby a considerably higher useful live of the slider can be achieved in case of alternating motions, that is quick motions back and forth f.ex. at mains frequency.

We claim:

1. Slider adapted to be moved in a direction of movement along an electrically conducting element and to establish electrical contact therewith, comprising (a) a generally u-shaped slider support having a central portion and two substantially parallel legs, and defining an interior area between said legs, (b) a first leaf spring depending from said slider support and extending into said interior area, said first leaf spring having a first end and a second end, said first end of said first leaf spring being attached to one of said legs of said slider support and said second end of said first leaf spring having contact means for contacting said electrically conducting element, (c) a second leaf spring depending from said slider support and extending into said interior area in a direction substantially opposite to a first direction, said second leaf spring having a first end and a second end, said first end of said second leaf spring being attached to the other one of said legs of said slider support and said second end of said second leaf spring, with a bias, engaging said first leaf spring on the side thereof remote from said electrically conducting element, said leaf springs forming an obtuse angle, (d) said second leaf spring being dimensioned, relative to said first leaf spring, to vary the bias torque, which is exerted by said second leaf spring on said first leaf spring under the action of an inertial force acting on said second leaf spring in said first direction parallel to said direction of movement and due to an acceleration of said slider in a second, opposite direction, said bias torque variation substantially compensating a torque on said first leaf spring due to the action of the inertial force on said first leaf spring caused by said same acceleration.

(e) whereby, in operation, the contact force between said contact means and said electrically conducting element is maintained on a substantially constant low level, when inertial forces parallel to said direction of movement act on said leaf springs.

2. Slider as claimed in claim 1, wherein said second leaf spring is longer than said first leaf spring.

3. Slider as claimed in claim 2, wherein said second leaf spring has substantially the same mass as said first leaf spring.

4. Slided as claim in claim 3, wherein said second, longer leaf spring has an elongated longitudinal aperture therethrough to reduce its mass, forming two arms on the sides of said aperture.

5. Slider as claimed in claim 1, wherein said slider support comprises a flat element with said central portion located in a plane and said legs extending therefrom in a direction transverse to said direction of movement, said legs being deflected out of the plane towards one side thereof about lines parallel to said transverse direction to form obtuse angles with said central portion, and said leaf springs are attached to said legs with their first ends extending parallel to the planes of said deflected legs.

6. Slider as claimed in claim 1 including a second electrically conducting element extending parallel to the first element, and in which third and fourth leaf springs are attached to said legs, all of said leaf springs consisting of integral portions of a body of spring sheet metal, said third and fourth leaf springs extending substantially parallel to said first and second leaf springs, and said third leaf springs has a contact means engaging said second electrically conducting element and said fourth leaf spring engages said third leaf spring in a manner substantially identical to contact of said first leaf spring by said second leaf spring.

* * * * *